US006141934A

United States Patent [19]

Zeigler

[11] Patent Number: 6,141,934

[45] Date of Patent: Nov. 7, 2000

[54] FOLDING FRAME SYSTEM WITH FOLDABLE LEG ASSEMBLY AND METHOD OF ERECTING A FOLDING FRAME SYSTEM

[75] Inventor: Theodore R. Zeigler, Alexandria, Va.

[73] Assignee: World Shelters, Inc., Alexandria, Va.

[21] Appl. No.: 09/206,567

[22] Filed: Dec. 7, 1998

[51] Int. Cl.[7] ..... E04H 12/18

[52] U.S. Cl. ..... 52/646; 52/648; 52/109; 248/166; 248/167; 135/107; 135/108; 135/112; 135/908

[58] Field of Search ..... 52/79.5, 109, 648, 52/646; 248/166, 167, 168, 170, 188.1, 188.7, 188.6

[56] References Cited

U.S. PATENT DOCUMENTS

| | | | |
|---|---|---|---|
| Re. 33,710 | 10/1991 | Zeigler | 52/648 |
| 3,968,808 | 7/1976 | Zeigler . | |
| 4,026,313 | 5/1977 | Zeigler . | |
| 4,290,244 | 9/1981 | Zeigler . | |
| 4,437,275 | 3/1984 | Zeigler . | |
| 5,230,196 | 7/1993 | Zeigler . | |
| 5,274,980 | 1/1994 | Zeigler | 52/646 |
| 5,444,946 | 8/1995 | Zeigler . | |

*Primary Examiner*—Carl D. Friedman
*Assistant Examiner*—Patrick J. Chavez
*Attorney, Agent, or Firm*—Burns, Doane, Swecker & Mathis, LLP

[57] ABSTRACT

A folding frame system includes a roof assembly including at least three pivotably attached strut pairs, adjacent pairs of the at least three pivotably attached strut pairs defining at least three corners of the roof assembly. The roof assembly is movable between a roof assembly closed position in which struts of the at least three strut pairs are disposed parallel to each other and a roof assembly open position in which struts of the at least three strut pairs are locked in non-parallel positions and ends of the struts of each strut pair of the at least three strut pairs define a rectangle. The folding frame system also includes a folding leg assembly disposed at each of the at least three corners of the roof assembly. Each folding leg assembly includes a leg strut assembly. The leg strut assembly includes a top leg strut and a tubular bottom leg strut in which the top leg strut is telescopingly slidable between a top leg strut closed position and a top leg strut open position. A top end of the top leg strut includes a joint pivotably attaching the top end of the top leg strut to an end of a strut of a strut pair of the at least three strut pairs. The folding leg assembly also includes a lock for locking the top leg strut in the top leg strut open position. The folding leg assembly also includes at least one arm strut assembly. The arm strut assembly is pivotably attached at a bottom end to a point on the bottom leg strut. A top end of the arm strut assembly includes a joint pivotably attaching the top end of the arm strut assembly to at least one strut of the strut pair to which the top end of the top leg strut is pivotably attached.

18 Claims, 6 Drawing Sheets

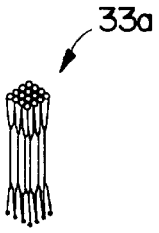
FIG. 2A
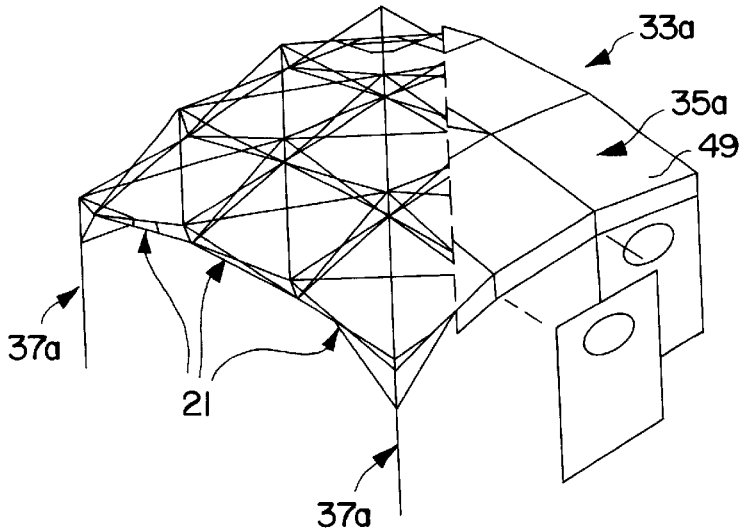
FIG. 2B
FIG. 3A
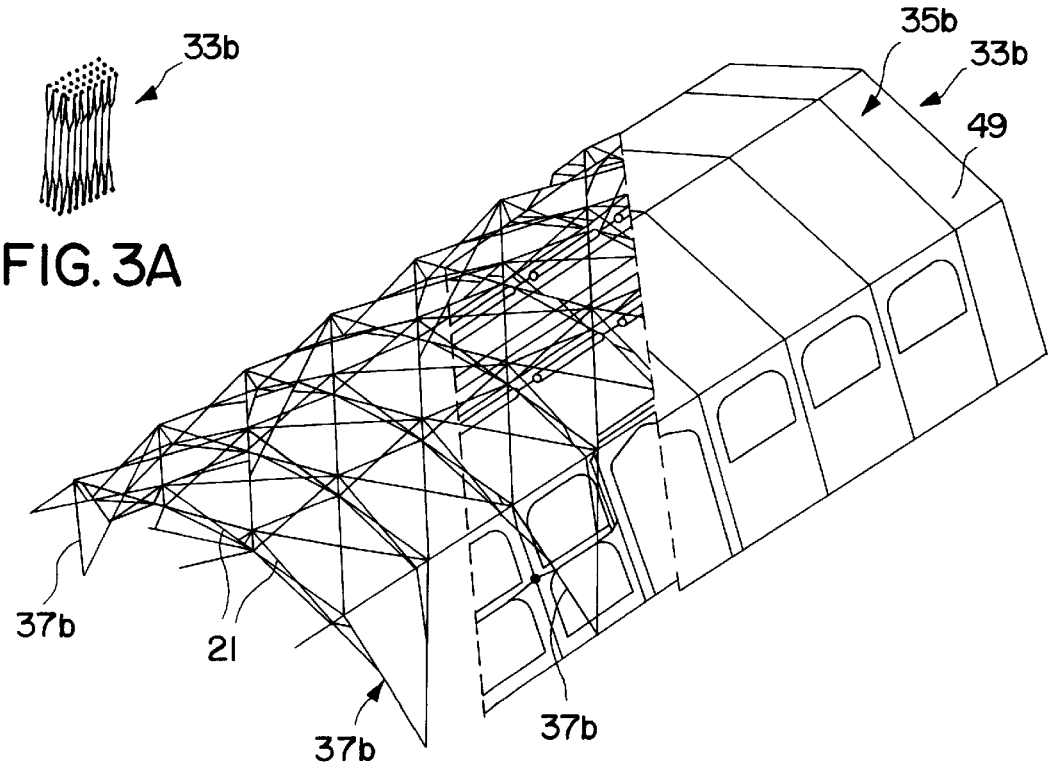
FIG. 3B

FOLDING FRAME SYSTEM WITH FOLDABLE LEG ASSEMBLY AND METHOD OF ERECTING A FOLDING FRAME SYSTEM

FIELD OF THE INVENTION

The present invention relates to folding frame systems and, more particularly, to folding frame systems having folding leg assemblies.

BACKGROUND AND SUMMARY

In my prior U.S. Pat. Nos. 3,968,808, 4,026,313, 4,290,244, 4,437,275, Re. 33,710, 5,230,196 and 5,444,946 I have disclosed interconnected pentagonal, hexagonal, rectangular, or square sections or modules for forming collapsible and expandable portable shelters. The shelters formed by these modules are light in weight and adapted to be quickly put up and taken down. The modules and shelters formed from the modules disclosed in, for example, my U.S. Pat. Nos. 3,968,808 and Re. 33,710 are self-supporting by virtue of a self-locking action resulting from the asymmetrical disposition of certain strut members forming the modules.

My U.S. Pat. Nos. 5,230,196 and 5,444,946 provide systems including modules formed of pivotably pinned pairs of struts arranged on the sides of the modules. The strut pairs are pivotably attached to engageable and disengageable locking devices defining corners of the modules. When the locking devices are disengaged, the modules are adapted to fold into a bundle. When the modules are unfolded, the locking devices are manually engaged to form the expanded modules. The expanded modules including manually engaged locking devices exhibit enhanced resistance to stress-inducing conditions.

My U.S. Pat. No. 5,274,980 discloses a polyhedron building system including a canopy section and telescoping leg assemblies at corners of the canopy. The polyhedron building system is conveniently deployed without tools by persons standing at ground level. The building system is unfolded from a folded condition and, while the leg assemblies are locked in position relative to the components of the canopy but before telescoping the leg assemblies to their full length, the components of the canopy section are locked in place by workers underneath the canopy. Because the canopy has a relatively small pitch, it is a simple matter for workers to reach the components. After the canopy is assembled, the legs are telescoped to their full height.

It is desirable to provide collapsible and expandable folding frame systems that are light in weight, and that exhibit high resistance to stress-inducing conditions. It is further desirable to provide expandable and collapsible folding frame systems that are adapted to be quickly put up at a site without tools, and are adapted to be put up by workers at ground level, without the need for ladders, or other similar equipment. It is further desirable to provide a folding frame system that is easy to store and transport.

In accordance with one aspect of the present invention, a folding frame system is provided. The folding frame system includes a roof assembly including at least three pivotably attached strut pairs, adjacent pairs of the at least three pivotably attached strut pairs defining at least three corners of the roof assembly. The roof assembly is movable between a roof assembly closed position in which struts of the at least three strut pairs are disposed parallel to each other and a roof assembly open position in which struts of the at least three strut pairs are locked in non-parallel positions and ends of the struts of each strut pair of the at least three strut pairs define a rectangle. The folding frame system also includes a folding leg assembly disposed at each of the at least three corners of the roof assembly. Each folding leg assembly includes a leg strut assembly. The leg strut assembly includes a top leg strut and a tubular bottom leg strut in which the top leg strut is telescopingly slidable between a top leg strut closed position and a top leg strut open position. A top end of the top leg strut includes a joint pivotably attaching the top end of the top leg strut to an end of a strut of a strut pair of the at least three strut pairs. The folding leg assembly also includes a lock for locking the top leg strut in the top leg strut open position. The folding leg assembly also includes at least one arm strut assembly. The arm strut assembly is pivotably attached at a bottom end to a point on the bottom leg strut. A top end of the arm strut assembly includes a joint pivotably attaching the top end of the arm strut assembly to at least one strut of the strut pair to which the top end of the top leg strut is pivotably attached.

According to another aspect of the present invention, a folding leg assembly for a folding frame system is provided. The folding frame system includes a plurality of pivotably attached strut pairs. The folding frame system is movable between a folding frame closed position in which struts of the plurality of strut pairs are disposed parallel to each other and a folding frame open position in which struts of the plurality of strut pairs are locked in non-parallel positions and ends of the struts of each strut pair of the plurality of strut pairs define a rectangle. The leg assembly includes at least one leg strut assembly. The leg strut assembly includes a top leg strut and a tubular bottom leg strut in which the top leg strut is telescopingly slidable between a top leg strut closed position and a top leg strut open position. A top end of the top leg strut includes a joint for pivotable attachment to an end of a strut of a strut pair of the plurality of strut pairs of the folding frame system. The leg strut assembly also includes a lock for locking the top leg strut in the top leg strut open position. The leg strut assembly also includes at least one arm strut assembly. The arm strut assembly is pivotably attached at a bottom end to a point on the bottom leg strut. A top end of the arm strut assembly includes a joint for pivotable attachment to the folding frame system.

According to yet another aspect of the present invention, a method for erecting a folding frame system is provided. According to the method, a roof assembly including at least three pivotably attached strut pairs, adjacent pairs of the at least three pivotably attached strut pairs defining at least three corners of the roof assembly, is unfolded from a roof assembly closed position in which struts of the at least three strut pairs are disposed parallel to each other to a roof assembly open position in which struts of the plurality of strut pairs are disposed in nonparallel positions and ends of the struts of each strut pair of the plurality of strut pairs define a rectangle. The roof assembly is locked in the roof assembly open position. After locking the roof assembly in the roof assembly open position, folding leg assemblies disposed at each of the at least three corners of the roof assembly, each folding leg assembly including a leg strut assembly, the leg strut assembly including a top leg strut and a tubular bottom leg strut in which the top leg strut is telescopingly slidable between a top leg strut closed position and a top leg strut open position, a top end of the top leg strut including a joint pivotably attaching the top end of the top leg strut to an end of a strut of a strut pair of the at least three strut pairs, and at least one arm strut assembly, the arm strut assembly being pivotably attached at a bottom end to a point on the bottom leg strut, a top end of the arm strut assembly including a joint pivotably attaching the top end of the arm strut assembly to at least one strut of the strut pair to which the top end of the top leg strut is pivotably attached are unfolded by sliding the top leg strut from the top leg strut closed position to the top leg strut open position. The top leg strut is locked in the top leg strut open position.

BRIEF DESCRIPTION OF THE DRAWINGS

The features and advantages of the present invention are well understood by reading the following detailed description in conjunction with the drawings in which like numerals indicate similar elements and in which:

FIGS. 2A and 2B are perspective views of a folding frame system according to one embodiment of the present invention showing the folding frame system in a closed position and an open position, respectively;

FIGS. 3A and 3B are perspective views of a folding frame system according to another embodiment of the present invention showing the folding frame system in a closed position and an open position, respectively;

DETAILED DESCRIPTION

Figure 1:
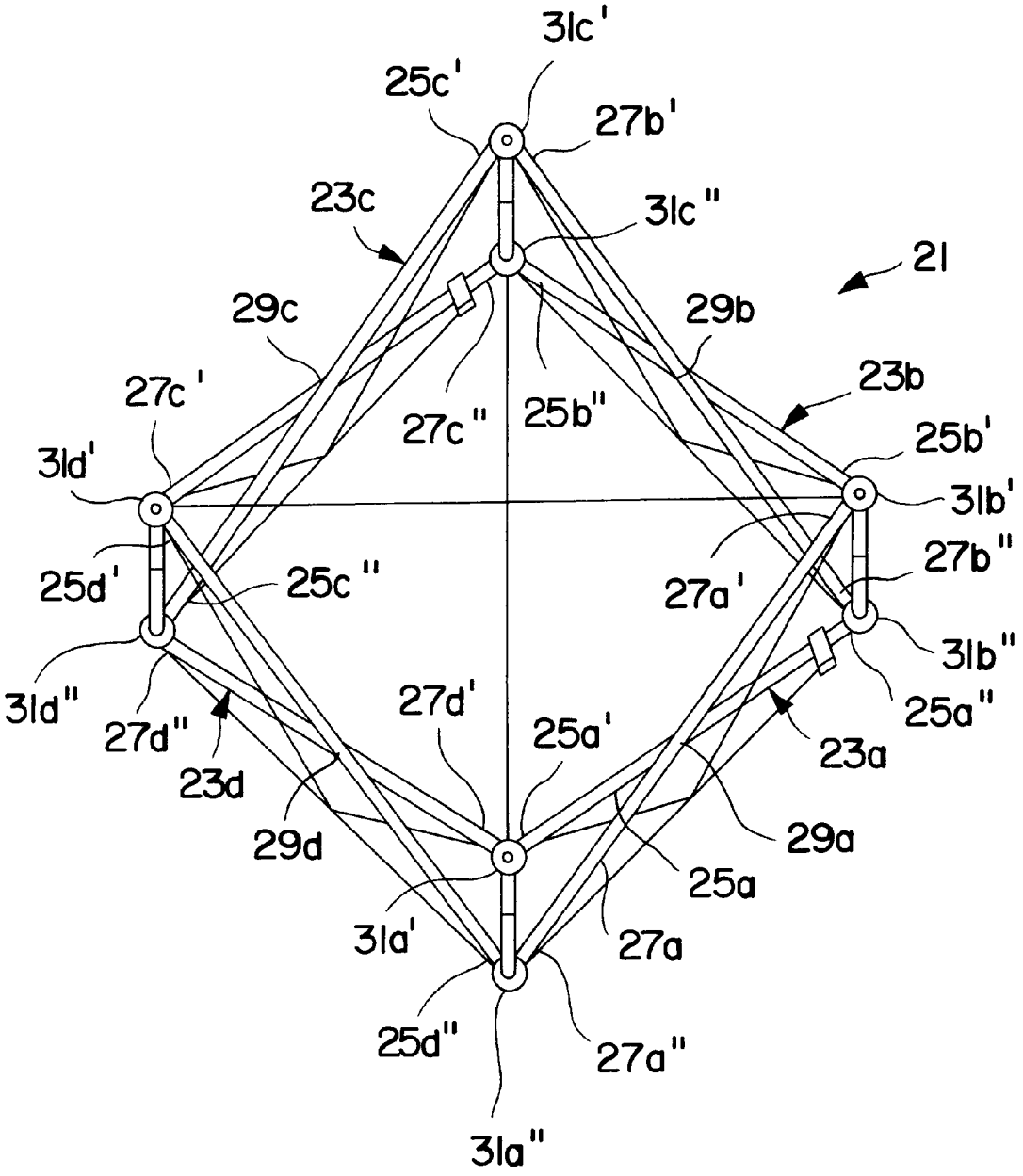
FIG. 1 is a perspective view of a module for a folding frame system according to an embodiment of the present invention.

The present invention is capable of application to a variety of folding structures. Examples of the types of folding frame systems with which the present application is capable of being used include my U.S. Pat. Nos. 3,968,808, 4,026,313, 4,290,244, 4,437,275, Re. 33,710, 5,230,196 and 5,444,946, which are hereby incorporated by reference. To illustrate a presently preferred embodiment of the present invention, the present invention will be described in connection with its application to expandable and collapsible modules and structures such as are disclosed in my U.S. Pat. No. 5,444,946. A module 21 of the type disclosed in this patent is shown in an expanded condition in FIG. 1. The module includes four strut pairs 23*a*, 23*b*, 23*c*, 23*d* interconnected to each other end to end. Each strut pair 23*a*, 23*b*, 23*c*, 23*d* includes two struts 25*a*, 27*a*, 25*b*, 27*b*, 25*c*, 27*c*, 25*d*, 27*d*.

The struts 25*a*, 27*a*, 25*b*, 27*b*, 25*c*, 27*c*, 25*d*, 27*d* of the strut pairs 23*a*, 23*b*, 23*c*, 23*d* are connected to one another by pivot pins 29*a*, 29*b*, 29*c*, 29*d* disposed substantially at the centers of the struts. Depending upon the shape of the folding frame system that is desired to be built, the locations of the pivot pins 29*a*, 29*b*, 29*c*, 29*d* may be offset from centers of the struts 25*a*, 27*a*, 25*b*, 27*b*, 25*c*, 27*c*, 25*d*, 27*d*.

Each strut 25*a*, 27*a*, 25*b*, 27*b*, 25*c*, 27*c*, 25*d*, 27*d* has what shall be referred to herein as a top end 25*a*', 27*a*', 25*b*', 27*b*', 25*c*', 27*c*', 25*d*', 27*d*' and a bottom end 25*a*", 27*a*", 25*b*", 27*b*", 25*c*", 27*c*", 25*d*", 27*d*". Top hub assemblies 31*a*', 31*b*', 31*c*', 31*d*' pivotally interconnect top ends 27*d*' and 25*a*', 27*a*' and 25*b*', 27*b*' and 25*c*', 27*c*' and 25*d*', and bottom hub assemblies 31*a*", 31*b*", 31*c*", 31*d*" pivotally interconnect bottom ends 25*d*" and 27*a*", 25*a*" and 27*b*", 25*b*" and 27*c*", and 25*c*" and 25*d*". The top hub assemblies 31*a*', 31*b*', 31*c*', 31*d*' preferably lock to the bottom hub assemblies 31*a*", 31*b*", 31*c*", 31*d*" to lock the strut pairs 23*a*, 23*b*, 23*c*, 23*d* in open, non-parallel positions. When the hub assemblies are unlocked, the module 21 may be folded to a closed position in which the struts 25*a*, 27*a*, 25*b*, 27*b*, 25*c*, 27*c*, 25*d*, 27*d* of the strut pairs 23*a*, 23*b*, 23*c*, 23*d* are parallel to one another. It will be understood that the struts may not, in fact, be perfectly parallel to one another for various reasons (e.g., the hub assemblies may interfere with folding the struts to perfectly parallel positions) not important to the present invention but, for convenience of discussion, they will be referred to as being parallel when in the closed position in the present application. In addition to the foregoing components of the modules 21, various wires typically extend diagonally across the modules for added rigidity. If desired or necessary, instead of the hub assemblies of the type disclosed in my U.S. Pat. No. 5,444,946, hub assemblies in the form of multiple, preferably two, U-shaped members, secured together, such as by welding or rivets and having male and female members extending perpendicularly from the secured U-shaped members that mate with each other and are pinned together may be used. It will be appreciated that various structures that facilitate holding the ends of the struts in position relative to each other and permit relative pivoting of the struts may be used.

The foregoing has described only one type of possible module 21. A folding frame system may be formed from as few as one module. Other types of modules suitable for use with the present invention may possess as few as three interconnected strut pairs. The present invention is not, however, necessarily limited to application with folding frame systems having interconnected strut pairs, and other folding frame systems that are based on other types of fundamental components may be used.

As seen in FIGS. 2A and 2B, and 3A and 3B, when several of the modules 21 are interconnected together, folding frame assemblies 33*a* and 33*b* of various shapes and sizes can be formed, including structures of significant size. FIGS. 2A and 3A show the open folding frame systems 33*a* and 33*b* shown in FIGS. 2B and 3B in folded or closed positions. Each folding frame system 33*a* and 33*b* includes a roof assembly 35*a* and 35*b*. Folding leg assemblies 37*a* and 37*b* are provided at least at the corners of the roof assemblies. As is seen with reference to the folding frame system 33*b* shown in FIG. 3B, folding leg assemblies 37*b* may be provided at non-corner locations of the roof assembly 35*b*. If desired or necessary, folding leg assemblies 37*a* and 37*b* may be used together on the same folding frame systems, and the folding leg assemblies 37*a* and 37*b* are not limited to use on roof assemblies 35*a* and 35*b*, respectively, and may be used with roof assemblies of different types.

Figures 4, 5, 6:
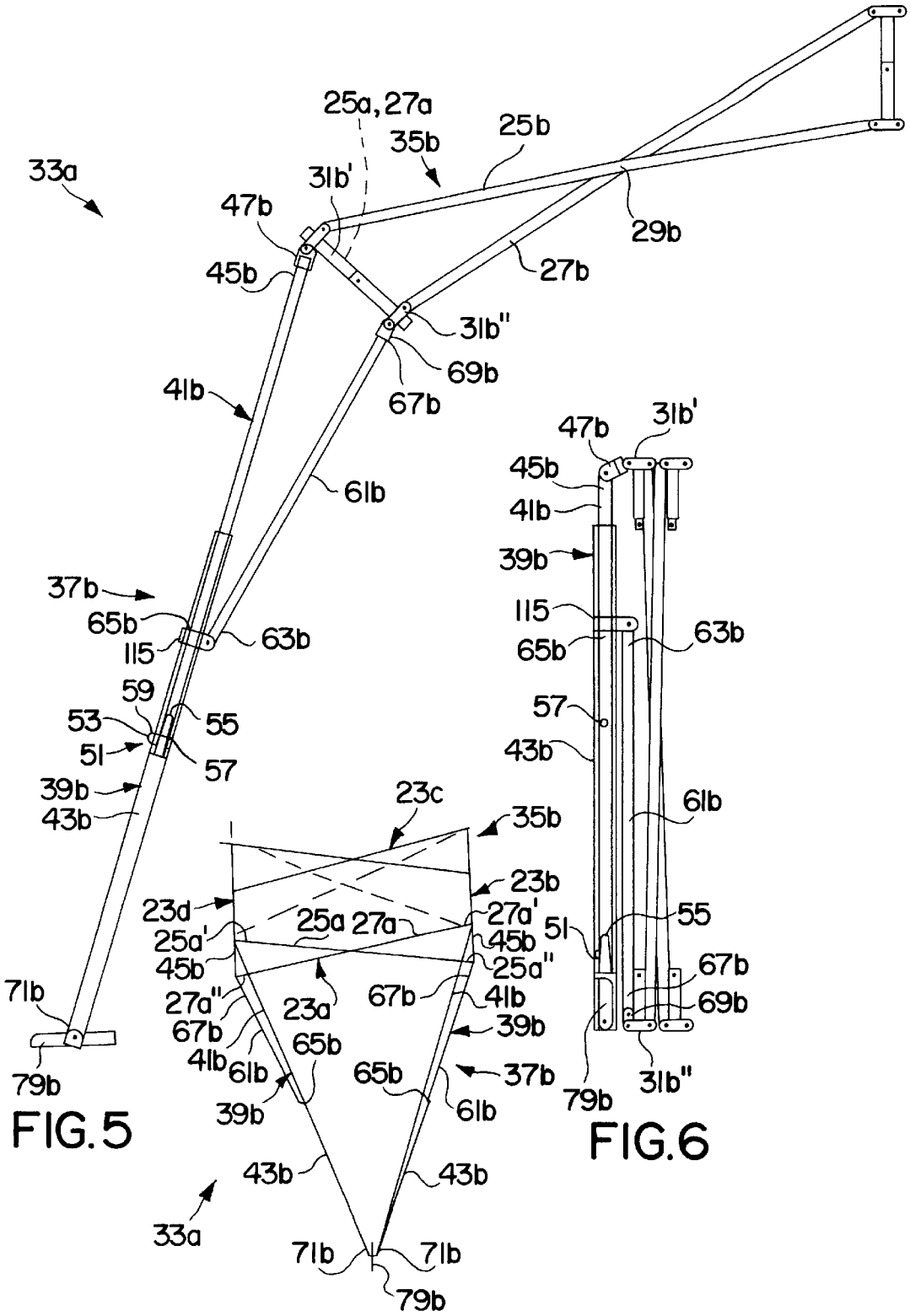
FIG. 4 is a perspective view of a portion of a folding frame system according to an embodiment of the present invention.
FIG. 5 is a partially cross-sectional side view of a portion of a folding frame system in an open position according to an embodiment of the present invention.
FIG. 6 is a partially cross-sectional side view of a portion of a folding frame system in a closed position according to an embodiment of the present invention.

In an embodiment of the folding frame system 33*b*, part of which is shown in FIGS. 4–6, a roof assembly 35*b* includes at least three, preferably four pivotably attached strut pairs 23*a*, 23*b*, 23*c*, 23*d*. Adjacent pairs of the strut pairs define at least three, preferably four, corners of the roof assembly 35*b*. The roof assembly 35*b* is movable between a roof assembly closed position in which struts of the strut pairs 23*a*, 23*b*, 23*c*, 23*d* are disposed parallel to each other and a roof assembly open position in which struts of the plurality of strut pairs are locked in nonparallel positions and ends of the struts of each strut pair of the plurality of strut pairs define a rectangle.

A folding leg assembly 37*b* is preferably disposed at each of the corners of the roof assembly 35*b* and, if desired or necessary, along non-corner portions of the roof assembly. Each folding leg assembly 37*b* includes a leg strut assembly 39*b*. The leg strut assembly 39*b* includes a top leg strut 41*b* and a tubular bottom leg strut 43*b* in which the top leg strut is telescopingly slidable between a top leg strut closed position and a top leg strut open position. As used herein, the word tubular may include non-circular tubes. As seen in FIGS. 5 and 6, a top end 45*b* of the top leg strut 41*b* includes a joint 47*b* pivotably attaching the top end of the top leg strut to a top end of a strut of a strut pair of the strut pairs. As seen in FIGS. 5 and 6, the top end 45*b* of the top leg strut 41*b* is attached to the hub 31*b*' connecting the top ends of the strut pairs 23*a* and 23*b* but, for ease of discussion, the connection will be referred to as a connection to the strut When a cover 49 (FIGS. 2B and 3B) is secured over the folding frame system 33*b*, the folding leg assembly 37*b* and the roof assembly 35*b* tend to provide a relatively continuous support surface for the cover.

As seen in FIGS. 5 and 6, the folding leg assembly 37*b* also includes a lock 51 for locking the top leg strut 41*b* relative to the bottom leg strut 43*b* in the top leg strut open position. The lock 51 is preferably a spring loaded pin-type lock including, as seen in FIG. 5, a pin 53 attached to a spring 55 disposed inside of the top leg strut 41*b*, with the pin partially extending out of a hole 57 in the top leg strut and locking the top leg strut 41*b* relative to the bottom leg strut 43*b* by being received in an opening 59 in the bottom leg strut. Other types of lock structures are also suitable, such as pins that are not spring loaded and mate with holes in the top and bottom leg struts 41*b* and 43*b*, keying arrangements, and the like.

As seen in FIGS. 5 and 6, the folding leg assembly 37*b* also includes at least one arm strut assembly 61*b*. The arm strut assembly 61*b* is pivotably attached at a bottom end 63*b* to a point 65*b* on the bottom leg strut 43*b*. A top end 67*b* of the arm strut assembly 61*b* includes a joint 69*b* pivotably attaching the top end of the arm strut assembly to at least one strut of the strut pair to which the top end 45*b* of the top leg strut 41*b* is pivotably attached. To this point, the description of the folding leg assembly 37*b* is the same as the description of the folding leg assembly 37*a* shown in FIGS. 7–9.

In the embodiment of the folding leg assembly 37*b* shown in FIGS. 3B and 4–6, and as seen in FIG. 4, each folding leg assembly includes two leg strut assemblies 39*b*, 39*b* and two arm strut assemblies 61*b*, 61*b*. One arm strut assembly of the two arm strut assemblies 61*b*, 61*b* is pivotably attached to one leg strut assembly of the two leg strut assemblies 39*b*, 39*b*. The two leg strut assemblies 39*b*, 39*b* are pivotably attached to each other at bottom ends 71*b*, 71*b* of bottom leg struts 43*b*, 43*b* of the two leg strut assemblies. Top ends 45*b*, 45*b* of top leg struts 41*b*, 41*b* of the two leg strut assemblies 39*b*, 39*b* each include a joint 47*b*, 47*b* (FIGS. 5 and 6) pivotably attaching the top ends of the top leg struts to top ends 25*a*', 27*a*' of struts 25*a*, 27*a* of a strut pair 23*a* of the strut pairs. Top ends 67*b*, 67*b* of the two arm strut assemblies 61*b*, 61*b* each include a joint 69*b*, 69*b* (FIGS. 5 and 6) pivotably attaching the top ends of the arm strut assemblies to bottom ends 25*a*", 27*b*" of the struts 25*a*, 27*a* of the strut pair 23*a*.

It will be appreciated that, while the folding leg assembly 37*b* is preferably provided at least at corners of the roof assembly 35*b*, the folding leg assembly 37*b* may also be provided at non-corner parts of the roof assembly as shown in FIG. 3B. For example, when the roof assembly includes at least five strut pairs connected end to end, it is possible that one of the strut pairs will be removed from one of three corners of a roof assembly. A folding leg assembly can be attached to this non-corner strut pair such that top ends of top leg struts of the two leg strut assemblies are pivotably attached by the joint at the top ends of the top leg struts of the folding leg assembly to top ends of struts of the at least one strut pair, and top ends of arm strut assemblies of the two arm strut assemblies are each pivotably attached by the joint at the top ends of the arm struts of the folding leg assembly to bottom ends of the struts of the strut pair.

Figures 7, 8, 9:
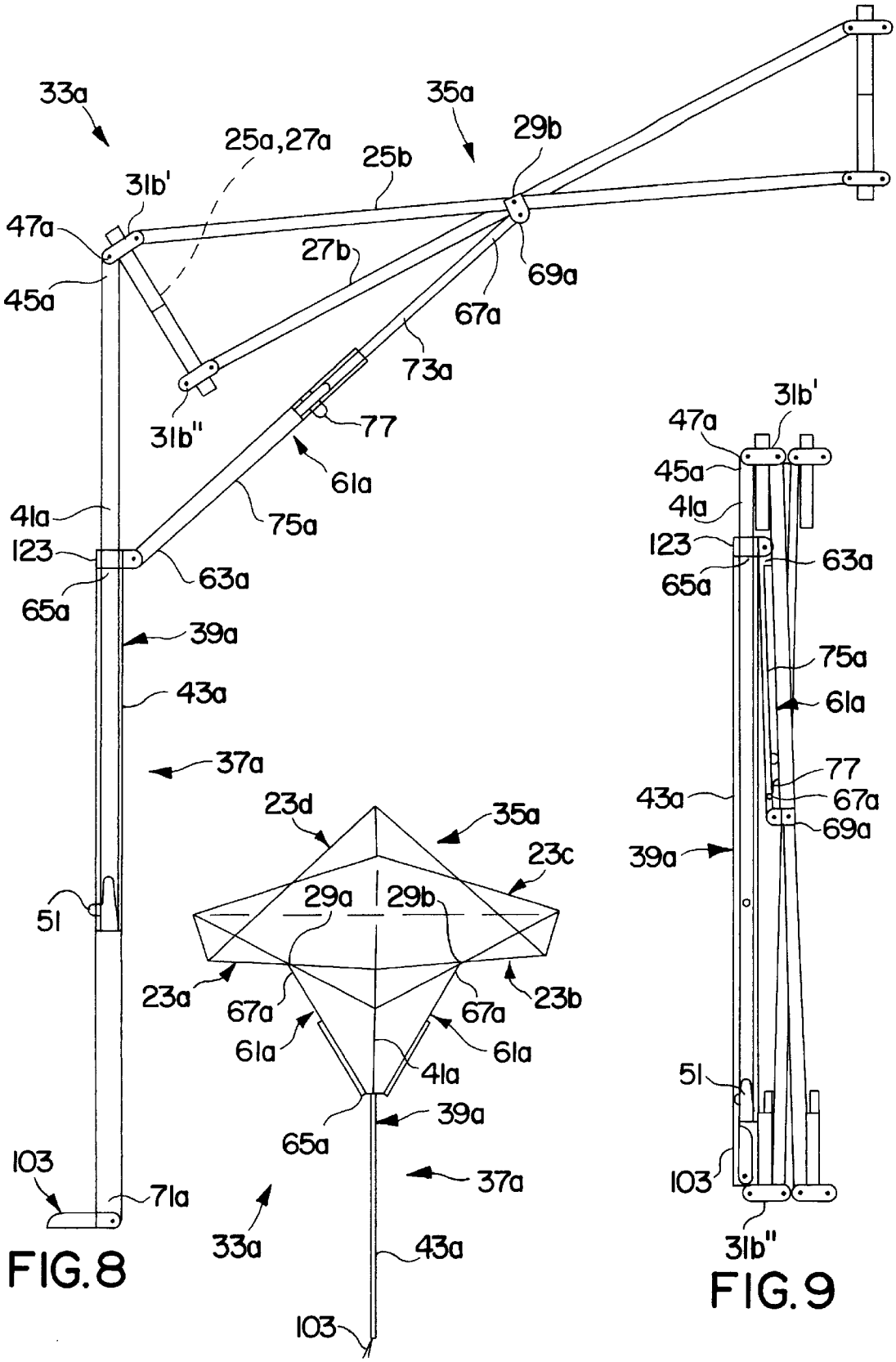
FIG. 7 is a perspective view of a portion of a folding frame system according to another embodiment of the present invention.
FIG. 8 is a partially cross-sectional side view of a portion of a folding frame system in an open position according to another embodiment of the present, invention.
FIG. 9 is a partially cross-sectional side view of a portion of a folding frame system in a closed position according to another embodiment of the present invention.

The folding frame system 33*a* shown in FIGS. 2A and 2B includes an embodiment of the folding leg assembly 37*a* that is similar in many respects to the embodiment of the folding leg assembly 37*b* described with reference to FIGS. 3B and 4–6. In the folding frame system 33*a*, part of which is shown in FIGS. 7–9, a roof assembly 35*a* includes at least three, preferably four pivotably attached strut pairs 23*a*, 23*b*, 23*c*, 23*d*. Adjacent pairs of the strut pairs define at least three, preferably four, corners of the roof assembly 35*a*. The roof assembly 35 is movable between a roof assembly closed position in which struts of the strut pairs 23*a*, 23*b*, 23*c*, 23*d* are disposed parallel to each other and a roof assembly open position in which struts of the plurality of strut pairs are locked in non-parallel positions and ends of the struts of each strut pair of the plurality of strut pairs define a rectangle.

A folding leg assembly 37*a* is preferably disposed at each of the corners of the roof assembly 35*a* and, if desired or necessary, along non-corner portions of the roof assembly. Each folding leg assembly 37*a* includes a leg strut assembly 39*a*. The leg strut assembly 39*a* includes a top leg strut 41*a* and a tubular bottom leg strut 43*a* in which the top leg strut is telescopingly slidable between a top leg strut closed position and a top leg strut open position. As seen in FIGS. 8 and 9, a top end 45*a* of the top leg strut 41*a* includes a joint 47*a* pivotably attaching the top end of the top leg strut to an end (seen in FIG. 7) of a strut of a strut pair of the strut pairs. While the drawings show the top end 45*a* of the top leg strut 41*a* attached to the top end of a strut, it will be appreciated that it is also possible to attach the top end of the top leg strut to a bottom end of a strut. It is presently preferred to attach the top end 45*a* of the top leg strut 41*a* to a top end of a strut because, when a cover 49 (FIGS. 2B and 3B) is secured over the folding frame system 33*a*, the folding leg assembly 37*a* and the roof assembly 35*a* tend to provide a somewhat more continuous support surface for the cover.

As seen in FIGS. 8 and 9, the folding leg assembly 37*a* also includes a lock 51 for locking the top leg strut 41*a* relative to the bottom leg strut 43*a* in the top leg strut open position. The folding leg assembly 37*a* also includes at least one arm strut assembly 61*a*. The arm strut assembly 61*a* is pivotably attached at a bottom end 63*a* to a point 65*a* on the bottom leg strut 43*a*. A top end 67*a* of the arm strut assembly 61*a* includes a joint 69*a* pivotably attaching the top end of the arm strut assembly to at least one strut of the strut pair 23*a* to which the top end 45*a* of the top leg strut 41*a* is pivotably attached.

Preferably, each folding leg assembly 37*a* includes two arm strut assemblies 61*a*, 61*a*. Top ends 67*a*, 67*a* of the two arm strut assemblies 61*a*, 61*a* each include a joint 69*a*, 69*a* for pivotable attachment to a pivotable connection point of different, adjacent strut pairs 23*a*, 23*b* of the roof assembly 35*a*, such as at the pins 29*a*, 29*b*, as seen in FIG. 7. Each arm strut assembly 61*a*, 61*b* is pivotable, in respective, non-parallel planes.

Each arm strut assembly 61*a*, 61*a* preferably includes a top arm strut 73*a*, 73*a* and a tubular bottom arm strut 75*a*, 75*a* in which the top arm strut is telescopingly slidable between a top arm strut closed position and a top arm strut open position. Each arm strut assembly 61*a*, 61*a* preferably also includes an arm strut lock 77 for locking the top arm strut 73*a*, 73*a* relative to the bottom arm strut 75*a*, 75*a* in the top arm strut open position. The lock 77 is preferably the same type of lock as the lock 51.

For both the embodiment of the folding leg assembly 39*a* and the folding leg assembly 39*b*, a length of the arm strut assembly 61*a*, 61*b* is preferably no greater than a distance between the pivotable attachment point 65*a*, 65*b* on the bottom leg strut 43*a*, 43*b* and a bottom end 71*a*, 71*b* of the bottom leg strut. In this manner, when the folding frame system 33*a* and 33*b* is moved to a closed position, part of the arm strut assembly 61*a*, 61*b* will not extend past the bottom end 71*a*, 71*b* of the bottom leg strut 43*a*, 43*b*.

Figure 10:
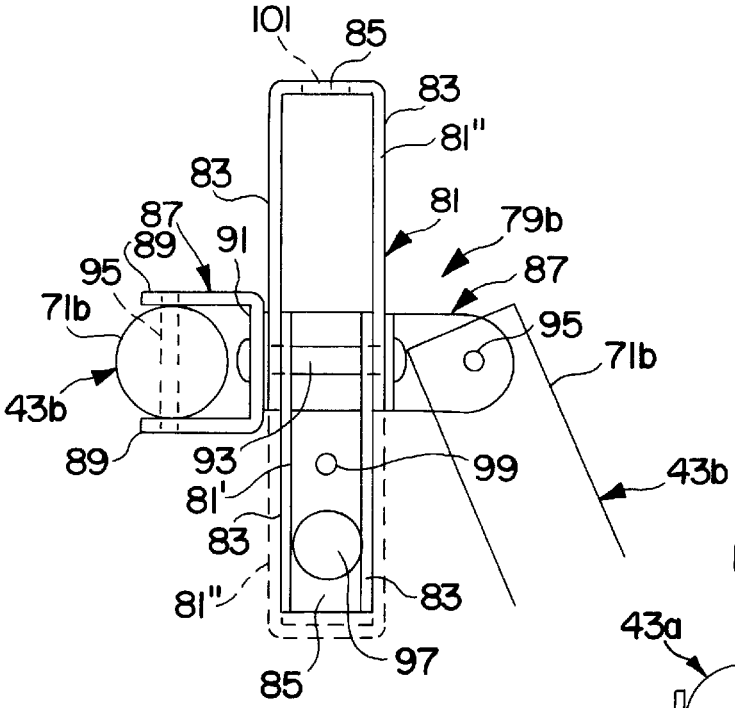
FIG. 10 is a top view of an embodiment of a bracket for a folding leg assembly according to an embodiment of the present invention.

The embodiment of the folding leg assembly 39*b* shown in FIGS. 4–6 preferably includes a bracket 79*b*, shown in FIG. 10, for pivotably attaching the two leg strut assemblies 39*b*, 39*b* to each other at bottom ends 71*b*, 71*b* of the bottom leg struts 43*b*, 43*b*. The bracket 79*b* permits universal pivotal movement of the two leg strut assemblies. The bracket 79 preferably includes a U-shaped central member 81 having two legs 83, 83 connected by a web 85, and two U-shaped foot members 87, 87 each having two legs 89, 89 connected by a web 91. The webs 91, 91 of the two U-shaped foot members 87, 87 are each attached to opposite legs 83, 83 of the U-shaped central member 81 by a pin 93 and are rotatable about the pin. Each U-shaped foot member 87, 87 of the U-shaped foot members receives one of the bottom ends 71*b*, 71*b* of the bottom leg struts 43*b*, 43*b* of the two leg strut assemblies 39*b*, 39*b* between the two legs 89, 89 of the U-shaped foot member. The bottom ends 71*b*, 71*b* of the bottom leg struts 43*b*, 43*b* of the two leg strut assemblies 39*b*, 39*b* are pivotably attached to the U-shaped foot member 87, 87 by a foot pin 95, 95.

The U-shaped central member 81 preferably includes one or more holes 97 in the web 85 of the U-shaped central member. Preferably, one of the holes 97 is of sufficient size to receive a suitably sized stake (not shown) for securing the leg assembly 37*b* to the ground. A second, smaller hole 99 is preferably also provided for receiving a smaller fastener, such as a bolt secured in concrete for use when using the folding frame system 33*b* on a man-made surface.

Preferably, the U-shaped central member 81 includes two U-shaped portions 81', 81" pivotably attached to each other by the pin 93. One of the U-shaped portions 81' is receivable between two legs and a web of the other one of the U-shaped portions 81". In this way, when the folding frame system 33*b* is folded to a closed position, the U-shaped portion 81' substantially does not extend beyond the bottom end 71*b* of the bottom leg strut 43*b* and the overall dimensions of the folding frame system are minimized. The web 85 of the U-shaped portion 81" preferably includes a hole 101 that is used in connection with securing a cover 49 to the folding frame system 33*b*.

Figure 11:
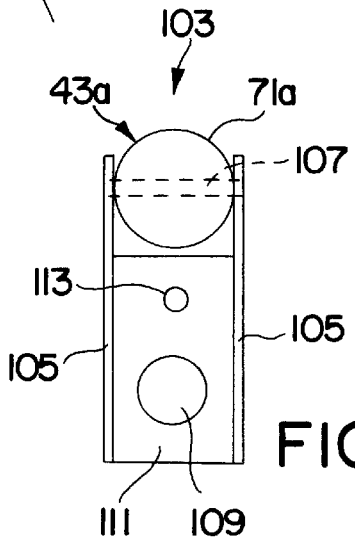
FIG. 11 is a top view of another embodiment of a bracket for a folding leg assembly according to an embodiment of the present invention.

As seen in FIG. 11, in the embodiment of the folding leg assembly 37*a* shown in FIGS. 7–9, the folding leg assembly preferably includes a U-shaped bracket 103 pivotably attached at the bottom end 71*a* of the bottom leg strut 43*a*. The bottom end 71*a* of the bottom leg strut 43*a* is disposed between legs 105, 105 of the bracket 103 and attached thereto by a pin 107. The bracket 103 is pivotable between a closed position in which the bracket is parallel with the bottom leg strut 43*a* and an open position in which the bracket is substantially perpendicular to the bottom leg strut. The bracket 103 also includes a hole 109 in a web 111 of the bracket for receiving a suitably sized stake, and a smaller hole 113 is preferably also provided for receiving a smaller fastener, such as a bolt secured in concrete for use when using the folding frame system 33*a* on a man-made surface.

Figure 12:
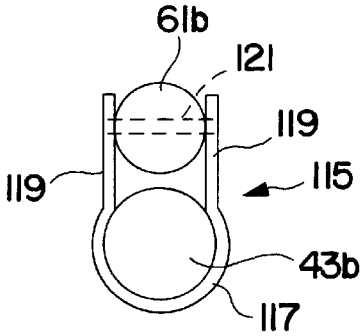
FIG. 12 is a top view of an arm strut assembly bracket according to an embodiment of the present invention.

In the embodiment of the folding leg assembly 37*b* shown in FIGS. 4–6, the arm strut assembly 61*b* is preferably pivotably attached to the bottom leg strut 43*b* by means of a substantially U-shaped bracket 115, shown in FIG. 12. The bracket 115 preferably includes a rounded portion 117 for receiving the bottom leg strut 43*b* and two substantially flat legs 119, 119 between which the bottom end 63*b* of the arm strut 61*b* is pivotally mounted by means of a pin 121.

Figure 13:
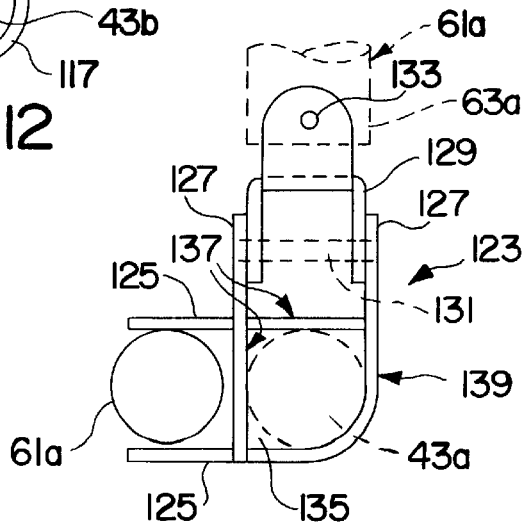
FIG. 13 is a top view of an arm strut assembly bracket according to another embodiment of the present invention.

In the embodiment of the folding leg assembly 37*a* shown in FIGS. 7–9, the arm struts 61*a*, 61*a* are preferably pivotably attached to the bottom leg strut 43*a* by means of a bracket 123, shown in FIG. 13. The bracket 123 preferably includes two pairs of legs 125, 125 and 127, 127 between which a universal joint member 129 is pinned by a pin 131. The bottom end 63*a* of the arm strut assembly 61*a* is pinned to the universal joint member 129 by another pin 133. The bottom leg strut 43*a* extends through an opening 135 in the bracket 123. The bracket 123 is preferably formed by welding together two straight members 137, 137 in the shape of a cross, and then welding the welded members to a bent member 139. The universal joint member 129 is preferably formed by bending opposing legs of a cross-shaped plate in opposite directions. While the universal joint member 129 is preferred, as seen in FIG. 13, the universal joint can be omitted and the bottom end 63*a* of an arm strut assembly 61*a* can be secured between the legs 125, 125 or 127, 127. A similar universal type joint is preferably used as the joint 47*a*, 47*b* and as the joint 69*b*. If desired or necessary, the joint 69*a* may be a universal type joint, and a universal type joint may be attached at the pivotable connection between the bottom leg strut 43*b* and the bottom end 63*b* of the arm strut assembly 61*b*.

Figure 14A:
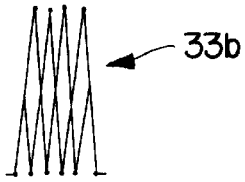
FIGS. 14A–14D are schematic side views of steps in a method of erecting a folding frame system according to the present invention.
Figure 14B:
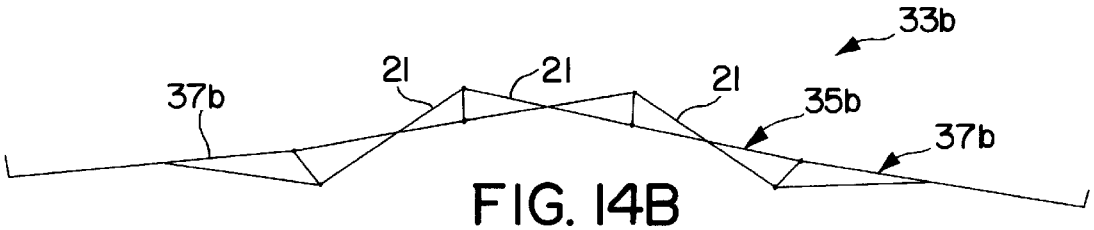
Figure 14C:
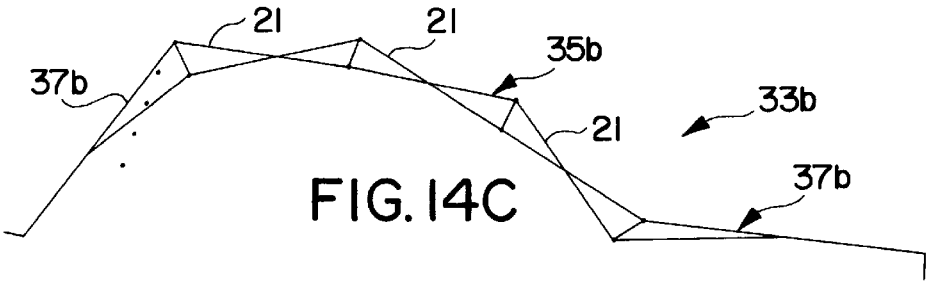
Figure 14D:
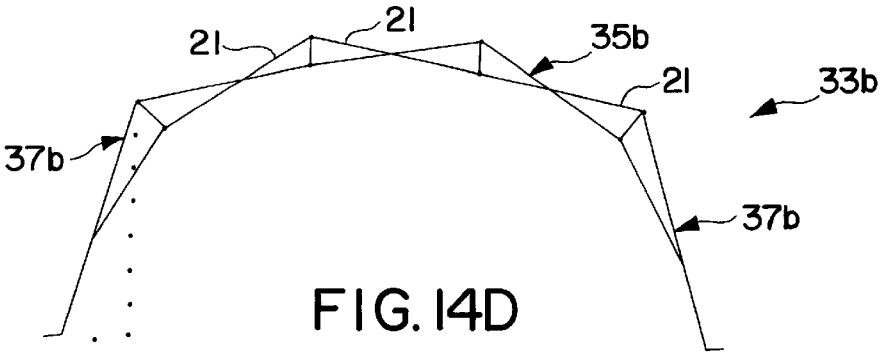

A method for erecting a folding frame system 33*b* according to the present invention is shown with reference to FIGS. 14A–14D. First, the roof assembly 35*b* is unfolded from a roof assembly closed position shown in FIG. 14A in which struts of the strut pairs are disposed parallel to each other to a roof assembly open position shown in FIG. 14B in which struts of the plurality of strut pairs are disposed in non-parallel positions and ends of the struts of each strut pair define a rectangle. The components of the roof assembly 35*b* are then locked in the roof assembly open position, preferably by a worker operating underneath the roof assembly and standing on the ground. After locking the roof assembly 35*b* in the roof assembly open position, the folding leg assemblies 37*b* disposed at each of the corners of the roof assembly 35*b* are unfolded by sliding the top leg strut 41*b* relative to the bottom leg strut 43*b* from the top leg strut closed position to the top leg strut open position, as seen in FIGS. 14C and 14D. The top leg strut 41*b* is then locked in the top leg strut open position. Because the folding leg assembly 37*b* is not unfolded until after the roof assembly 35*b* is unfolded and locked in the roof assembly open position, it is possible for a worker on ground level to deploy the folding frame system 33*b* without the need for ladders. If the folding frame system 33*b* includes a large number of modules 21 and has a substantial pitch when erected, the worker can lock modules at the center of the roof assembly first and work his way out to the edges of the roof assembly, thereby avoiding the need for ladders or other equipment. The method for erecting the folding frame system 33*a* is similar in most respects to the method described with respect to the folding frame system 33*b*. However, in addition to the foregoing steps, in erecting the folding frame system 33*a*, the method includes the further steps sliding the top arm strut 73*a*, 73*a* relative to the bottom arm strut 75*a*, 75*a* to the top arm strut open position and locking the top arm strut in the top arm strut open position.

While this invention has been illustrated and described in accordance with a preferred embodiment, it is recognized that variations and changes may be made therein without departing from the invention as set forth in the claims.

What is claimed is:

1. A folding frame system, the folding frame system comprising:

a roof assembly including at least three pivotably attached strut pairs, adjacent pairs of the at least three pivotably attached strut pairs defining at least three corners of the roof assembly, the roof assembly being movable between a roof assembly closed position in which struts of the at least three strut pairs are disposed parallel to each other and a roof assembly open position in which struts of the at least three strut pairs are locked in non-parallel positions and ends of the struts of each strut pair of the at least three strut pairs define a rectangle; and a folding leg assembly disposed at each of the at least three corners of the roof assembly, each folding leg assembly including a leg strut assembly, the leg strut assembly including a top leg strut and a tubular bottom leg strut in which the top leg strut is telescopingly slidable between a top leg strut closed position and a top leg strut open position, a top end of the top leg strut including a joint pivotably attaching the top end of the top leg strut to an end of a strut of a strut pair of the at least three strut pairs, a lock for locking the top leg strut in the top leg strut open position, and at least one arm strut assembly, the arm strut assembly being pivotably attached at a bottom end to a point on the bottom leg strut, a top end of the arm strut assembly including a joint pivotably attaching the top end of the arm strut assembly to at least one strut of the strut pair to which the top end of the top leg strut is pivotably attached.

2. The folding frame system as set forth in claim 1, wherein each folding leg assembly includes two leg strut assemblies and two arm strut assemblies, one arm strut assembly of the two arm strut assemblies being pivotably attached to one leg strut assembly of the two leg strut assemblies, the two leg strut assemblies being pivotably attached to each other at bottom ends of bottom leg struts of the two leg strut assemblies, top ends of top leg struts of the two leg strut assemblies each including a joint pivotably attaching the top ends of the top leg struts to top ends of struts of a strut pair of the at least three strut pairs, top ends of arm strut assemblies of the two arm strut assemblies each including a joint pivotably attaching top ends of the arm strut assemblies to bottom ends of the struts of the strut pair.

3. The folding frame system as set forth in claim 2, wherein the roof assembly includes more than three strut pairs, and at least one strut pair of the more than three strut pairs is a side strut pair removed from one of the at least three corners of the roof assembly, and wherein a folding leg assembly is attached to the at least one strut pair such that top ends of top leg struts of the two leg strut assemblies are pivotably attached by the joint at the top ends of the top leg struts of the folding leg assembly to top ends of struts of the at least one strut pair, and top ends of arm strut assemblies of the two arm strut assemblies are each pivotably attached by the joint at the top ends of the top arm struts of the folding leg assembly to bottom ends of the struts of the strut pair.

4. The folding frame system as set forth in claim 1, wherein each folding leg assembly includes two arm strut assemblies, top ends of arm strut assemblies of the two arm strut assemblies each including a joint for pivotable attachment to a pivotable connection point of different, adjacent strut pairs of the at least three strut pairs of the roof assembly, each arm strut assembly of the two arm strut assemblies being pivotable, in respective, non-parallel planes.

5. The folding frame system as set forth in claim 4, wherein each arm strut assembly of the two arm strut assemblies includes a top arm strut and a tubular bottom arm strut in which the top arm strut is telescopingly slidable between a top arm strut closed position and a top arm strut open position, and an arm strut lock for locking the top arm strut in the top arm strut open position.

6. The folding frame system as set forth in claim 1, wherein a length of the arm strut assembly being no greater than a distance between the pivotable attachment point on the bottom leg strut and a bottom end of the bottom leg strut.

7. A folding leg assembly for a folding frame system, the folding frame system including at least three pivotably attached strut pairs, the folding frame system being movable between a folding frame closed position in which struts of the at least three strut pairs are disposed parallel to each other and a folding frame open position in which struts of the at least three strut pairs are locked in nonparallel positions and ends of the struts of each strut pair of the at least three strut pairs define a rectangle, the leg assembly comprising:

at least one leg strut assembly, the leg strut assembly including a top leg strut and a tubular bottom leg strut in which the top leg strut is telescopingly slidable between a top leg strut closed position and a top leg strut open position, a top end of the top leg strut including a joint for pivotable attachment to an end of a strut of a strut pair of the at least three strut pairs of the folding frame system;

a lock for locking the top leg strut in the top leg strut open position;

at least one arm strut assembly, the arm strut assembly being pivotably attached at a bottom end to a point on the bottom leg strut, a top end of the arm strut assembly including a joint for pivotable attachment to the folding frame system.

8. The folding leg assembly as set forth in claim 7, wherein each folding leg assembly includes two leg strut assemblies and two arm strut assemblies, one arm strut assembly of the two arm strut assemblies being pivotably attached to one leg strut assembly of the two leg strut assemblies, the two leg strut assemblies being pivotably attached to each other at bottom ends of bottom leg struts of the two leg strut assemblies, top ends of top leg struts of the two leg strut assemblies each including a joint for pivotable attachment to top ends of struts of a strut pair of the at least three strut pairs, top ends of arm strut assemblies of the two arm strut assemblies each including a joint for pivotable attachment to bottom ends of the struts of the strut pair.

9. The folding leg assembly as set forth in claim 8, further comprising a bracket for pivotably attaching the two leg strut assemblies to each other at bottom ends of the bottom leg struts of the two leg strut assemblies, the bracket permitting universal pivotal movement of the two leg strut assemblies.

10. A folding leg assembly for a folding frame system, the folding frame system including at least three pivotably attached strut pairs, the folding frame system being movable between a folding frame closed position in which struts of the at least three strut pairs are disposed parallel to each other and a folding frame open position in which struts of the at least three strut pairs are locked in non-parallel positions and ends of the struts of each strut pair of the at least three strut pairs define a rectangle, the leg assembly comprising:

at least one leg strut assembly, the leg strut assembly including a top leg strut and a tubular bottom leg strut in which the top leg strut is telescopingly slidable between a top leg strut closed position and a top leg strut open position, a top end of the top leg strut including a joint for pivotable attachment to an end of a strut of a strut pair of the at least three strut pairs of the folding frame system;

a lock for locking the top leg strut in the top leg strut open position;

at least one arm strut assembly, the arm strut assembly being pivotably attached at a bottom end to a point on the bottom leg strut, a top end of the arm strut assembly including a joint for pivotable attachment to the folding frame system, wherein each folding leg assembly includes two leg strut assemblies and two arm strut assemblies, one arm strut assembly of the two arm strut assemblies being pivotably attached to one leg strut assembly of the two leg strut assemblies, the two leg strut assemblies being pivotably attached to each other at bottom ends of bottom leg struts of the two leg strut assemblies, top ends of top leg struts of the two leg strut assemblies each including a joint for pivotable attachment to top ends of struts of a strut pair of the at least three strut pairs, top ends of arm strut assemblies of the two arm strut assemblies each including a joint for pivotable attachment to bottom ends of the struts of the strut pair, a bracket for pivotably attaching the two leg strut assemblies to each other at bottom ends of the bottom leg struts of the two leg strut assemblies, the bracket permitting universal pivotal movement of the two leg strut assemblies, wherein the bracket includes a U-shaped central member having two legs connected by a web, and two U-shaped foot members each having two legs connected by a web, the webs of the two U-shaped foot members each being attached to opposite legs of the U-shaped central member by a pin and being rotatable about the pin, each U-shaped foot member of the U-shaped foot members receiving one of the bottom ends of the bottom leg struts of the two leg strut assemblies between the two legs of the U-shaped foot member, the bottom ends of the bottom leg struts of the two leg strut assemblies being pivotably attached to the U-shaped foot member by a foot pin.

11. The folding leg assembly as set forth in claim 10, wherein the U-shaped central member includes one or more holes in the web of the U-shaped central member.

12. The folding leg assembly as set forth in claim 10, wherein the U-shaped central member includes two U-shaped portions pivotably attached to each other by the pin, one of the U-shaped portions being receivable between two legs and a web of the other one of the U-shaped portions.

13. The folding leg assembly as set forth in claim 7, wherein each folding leg assembly includes two arm strut assemblies, top ends of arm strut assemblies of the two arm strut assemblies each including a joint for pivotable attachment to a pivotable connection point of different, adjacent strut pairs of the at least three strut pairs of the folding frame system, each arm strut assembly of the two arm strut assemblies being pivotable, in respective, non-parallel planes, between an arm strut assembly open position and an arm strut assembly closed position.

14. The folding leg assembly as set forth in claim 13, wherein each arm strut assembly of the two arm strut assemblies includes a top arm strut and a tubular bottom arm strut in which the top arm strut is telescopingly slidable between a top arm strut closed position and a top arm strut open position, and an arm strut lock for locking the top arm strut in the top arm strut open position.

15. The folding leg assembly as set forth in claim 13, further comprising a U-shaped bracket pivotably attached at a bottom end of the bottom leg strut, the bottom end of the bottom leg strut being disposed between legs of the bracket and attached thereto by a pin, the bracket being pivotable between a closed position in which the bracket is parallel with the bottom leg strut and an open position in which the bracket is substantially perpendicular to the bottom leg strut.

16. The folding leg assembly as set forth in claim 7, wherein a length of the arm strut assembly is no greater than a distance between the pivotable attachment point on the bottom leg strut and a bottom end of the bottom leg strut.

17. A method for erecting a folding frame system, comprising the steps of:

unfolding a roof assembly including at least three pivotably attached strut pairs, adjacent pairs of the at least three pivotably attached strut pairs defining at least three corners of the roof assembly, from a roof assembly closed position in which struts of the at least three strut pairs are disposed parallel to each other to a roof assembly open position in which struts of the at least three strut pairs are disposed in non-parallel positions and ends of the struts of each strut pair of the at least three strut pairs define a rectangle;

locking the roof assembly in the roof assembly open position;

after locking the roof assembly in the roof assembly open position, unfolding folding leg assemblies disposed at each of the at least three corners of the roof assembly, each folding leg assembly including a leg strut assembly, the leg strut assembly including a top leg strut and a tubular bottom leg strut in which the top leg strut is telescopingly slidable between a top leg strut closed position and a top leg strut open position, a top end of the top leg strut including a joint pivotably attaching the top end of the top leg strut to an end of a strut of a strut pair of the at least three strut pairs, and at least one arm strut assembly, the arm strut assembly being pivotably attached at a bottom end to a point on the bottom leg strut, a top end of the arm strut assembly including a joint pivotably attaching the top end of the arm strut assembly to at least one strut of the strut pair to which the top end of the top leg strut is pivotably attached by sliding the top leg strut from the top leg strut closed position to the top leg strut open position; and locking the top leg strut in the top leg strut open position.

18. The method as set forth in claim 17, wherein each folding leg assembly includes two arm strut assemblies, top ends of arm strut assemblies of the two arm strut assemblies each including a joint pivotably attaching the top ends of the arm strut assemblies to pivotable connection points of different, adjacent strut pairs of the at least three strut pairs of the roof assembly, each arm strut assembly of the two arm strut assemblies being pivotable, in respective, nonparallel planes, and wherein each arm strut assembly of the two arm strut assemblies includes a top arm strut and a tubular bottom arm strut in which the top arm strut is telescopingly slidable between a top arm strut closed position and a top arm strut open position, and an arm strut lock for locking the top arm strut in the top arm strut open position, wherein the method comprises the further steps sliding the top arm strut of each folding leg assembly to the top arm strut open position and locking the top arm strut of each folding leg assembly in the top arm strut open position.

* * * * *